US005184831A

United States Patent [19]

Garner

[11] Patent Number: 5,184,831

[45] Date of Patent: Feb. 9, 1993

[54] KARATE SCORING APPARATUS

[76] Inventor: Lee Garner, 272 A Harding Rd., Freehold, N.J. 07728

[21] Appl. No.: 779,359

[22] Filed: Oct. 17, 1991

[51] Int. Cl.[5] ..... A63B 69/00

[52] U.S. Cl. ..... 273/455; 200/DIG. 2; 482/84

[58] Field of Search ..... 273/455, 440, 445; 200/DIG. 2; 482/84

[56] References Cited

U.S. PATENT DOCUMENTS

| | | | |
|---|---|---|---|
| 1,165,970 | 12/1915 | Harris | 200/DIG. 2 X |
| 3,529,822 | 9/1970 | Rubin | 273/57.3 |
| 3,617,666 | 11/1971 | Brave | 200/86 |
| 3,804,406 | 4/1974 | Viscione | 273/454 X |
| 3,920,242 | 11/1975 | Reith et al. | 273/57.3 |
| 3,933,354 | 1/1976 | Goldfarb et al. | 273/445 |
| 4,299,386 | 11/1981 | Kulesza et al. | 273/85 G X |
| 4,353,545 | 10/1982 | Anderson | 273/440 X |
| 4,401,303 | 8/1983 | Anderson et al. | 273/440 X |
| 4,613,139 | 9/1986 | Robinson, II | 200/DIG. 2 X |

*Primary Examiner*—William H. Grieb
*Attorney, Agent, or Firm*—Arthur L. Plevy

[57] ABSTRACT

There is disclosed a glove employing an adjustable pressure sensitive means for use by contestants engaged in a karate contest. The glove assures that each contestant is associated with a given strike frequency. The gloves provide the strike frequency which will be transmitted when the contestant strikes a blow of sufficient force. Each glove is associated with a transmitter operating at a selected strike frequency and a pressure sensitive area which causes the transmitter to transmit the strike frequency. Also associated with each contestant is another pressure sensitive area which is a target area. When this area is struck by an opponent, a target frequency is transmitted. In order to determine that a valid blow was rendered, a receiver is incorporated and employed by a judge. The receiver will respond to two frequencies to determine whether a valid blow has been struck. The receiver must receive a first frequency indicative of the strike frequency and a second frequency indicative of the target frequency. In this manner the judge will know which opponent has struck a proper blow in regard to the transmission of both the strike and target frequencies.

16 Claims, 4 Drawing Sheets

KARATE SCORING APPARATUS

BACKGROUND OF THE INVENTION

This invention relates to pressure sensitive materials and apparatus for electronically scoring karate matches, and more particularly, to apparatus which will indicate to a judge which opponent scored a strike during a karate match.

The sport of karate is a martial art which has been participated in extensively. In modern day techniques matches are held whereby one opponent interfaces with another opponent during a contest. In any event, these contests can be scored in many different ways. Most matches are scored according to the number of strikes that one opponent makes on the other. In this way it is determined which of the two contestants involved in a match is the winner. Most of such contests involve the use of visual observation by officials who monitor the match and who determine whether or not contact has been made.

Due to the nature of a karate exhibition, it is extremely difficult to determine by visual means whether or not contact has been made. Hence, as one can readily understand, the determination of whether or not contact has been made is strictly a subjective determination and is a function of the experience of the judge or referee who is monitoring the match. It is further understood that the speed in which a blow is struck or flurries of blows are struck is often times extremely rapid hence making it more difficult for a judge or a referee to determine contact.

The art of providing electronic scoring has been employed in the prior art and various other sports, such as fencing, have devices which will provide an indication of contact. In any event, such devices, used for example in the sport of fencing, are not compatible with the problems involved in a karate match because different concerns and objectives are inherent with the sport of karate.

In order to gain some understanding of some of the electrical scoring apparatus which involve the art of fencing, reference is made to U.S. Pat. No. 3,529,822 issued Sep. 22, 1970 to L. R. Rubin and entitled ELECTRICAL APPARATUS FOR SCORING FENCING MATCHES. This patent shows an apparatus for scoring fencing matches which essentially operates to complete a circuit and light a lamp when a foil touches a screen in the scoring area of the opponent. The circuitry is also capable of registering fouls.

U.S. Pat. No. 3,920,242 issued on Nov. 18, 1975 to W. E. Reith et al. and entitled ELECTRICAL FENCING SCORING METHOD AND APPARATUS. This patent shows another system for electrically scoring fencing matches, which system produces audible and visual scoring signals which are then observed by a judge to determine contact. There are various other patents which involve electronic fencing games or similar devices and operate to also indicate contact. See for example U.S. Pat. No. 4,299,386 issued Nov. 10, 1981 to R. J. Kulesza et al. entitled ELECTRONIC FENCING GAME. This patent describes a toy device which essentially includes means for producing a signal by means of a conductive area on the toy fencer which is activated by the sword of the other fencer touching the area.

As indicated, the prior art was cognizant of devices to provide electronic scoring. Such devices are extremely complicated while certain of the devices require wires coupled to the person of each of the opponents in order to transmit such signals. The devices were replete with a number of inherent error producing situations whereby it would be difficult to determine actual contact and hence, in spite of such devices, discretion was required on behalf of the officials.

In order to circumvent such problems, it is an object of the present invention to provide an adjustable pressure sensitive material for use in karate equipment and an electronic scoring apparatus which is particularly adapted to monitor contact between opponents during a karate match.

It is a further object of this invention to provide a material and apparatus which is extremely light, economical and reliable and which apparatus will determine when proper contact has been made by a opponent during a karate exhibition or match.

BRIEF DESCRIPTION OF THE PREFERRED EMBODIMENT

An adjustable pressure sensitive means employed to indicate valid strikes scored in a karate match between first and second contestants engaged in combat according to the martial art of karate, said pressure sensitive means comprising first and second conductive elements with a slotted compressible insulation material located between said conductive elements, said first conductive element having projecting fingers located in said slots of said insulation material and extending part way through said slots of said insulation material, said insulation material being adjustable to compress in response to sufficient pressure being applied to said first element, and output means coupled to said first and second conductive elements for providing an output frequency, whereby upon sufficient pressure being applied to said first conductive element said insulation material compresses allowing said fingers to make electrical contact with said second conductive element such that said output frequency is provided.

DETAILED DESCRIPTION OF THE FIGURES

Figure 1:
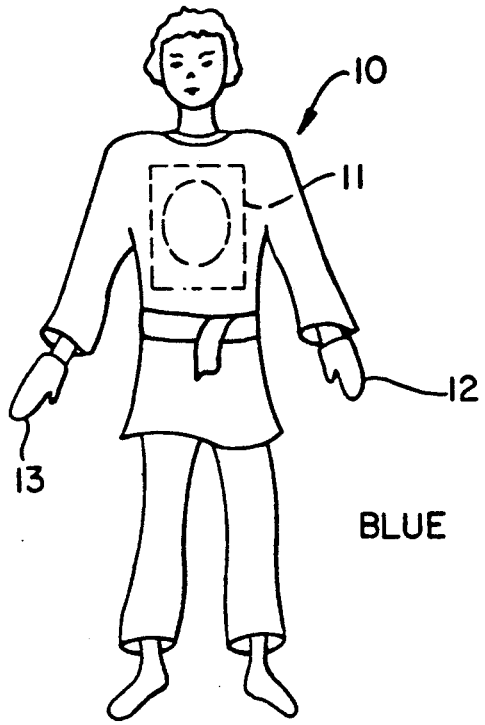
FIG. 1 is a diagram showing a typical karate contestant employing pressure sensitive transmitting devices according to this invention.

Referring to FIG. 1, there is shown a contestant or combatant 10. The contestant 10 normally employs a conventional karate uniform and based on the techniques to be described is one contestant about to participate in a karate match and designated as the blue contestant.

As shown in FIG. and based on this invention, the contestant is required to wear a vest 11. The vest 11 contains a pressure sensitive area or target area which, as will be explained, is associated with a particular frequency. As will be explained, if the opponent strikes the target area on the vest 11, a particular radio frequency signal will be transmitted. Thus, the vest 1; as shown in FIG. 1 is associated with a radio transmitter which may operate at a relatively high frequency such as in the FM band or the telemetry band. Hence, the transmitter associated with the vest is a well known device and can be extremely small because large distances for transmission purposes are not required. In this manner, the transmitter can be an extremely small device and would be associated with a typical battery such as a 12 volt battery.

The transmitter can be firmly positioned on the contestant's vest, as for example on the back of the same and be relatively light and unobtrusive. Also seen in FIG. 1 is the fact that the contestant 10 is wearing a glove as 12 and 13 on each hand. As will be explained, each glove for each contestant is associated with another frequency which is different from the frequency associated with the vest 11.

In this manner each of the gloves as 12 and 13 are also pressure sensitive devices and will emit the particular frequency when a strike is implemented. A strike causes the pressure sensitive material associated with the glove to close a contact thus allowing transmission of a glove or strike frequency. Thus, as briefly explained in regard to FIG. 1, each opponent in a karate match will wear a vest which is associated with a target frequency and further wears gloves 12 and 13 which are associated with a strike frequency.

Figure 2:
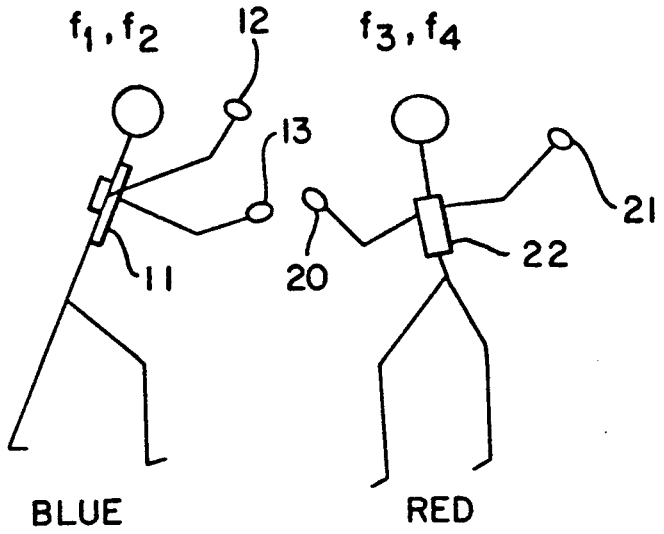
FIG. 2 is a simple diagram showing a stick figure representation of two contestants in a karate match employing apparatus according to this invention.

Referring to FIG. 2, there is shown stick configurations of two contestants in a karate match designated as a blue and red contestant. As seen from FIG. 2, the blue contestant has two frequencies associated therewith. One frequency is designated as F1 while the other frequency is F2. The frequency F1 is a strike frequency and is the frequency emitted when the blue contestant strikes any particular area or any object. This frequency is thus transmitted whenever pressure is exerted on the gloves 12 and 13 associated with the blue contestant.

As seen in FIG. 2, the target area 11 is associated with the frequency F2. Hence when the target area 11 of the blue contestant is struck by any object, the frequency F2 is emitted. In regard to FIG. 2, it is seen that the red contestant is associated with frequencies F3 and F4. F3 as will be explained is the strike frequency and is associated with the gloves 20 and 21 of the red contestant while F4 is the target frequency and is associated with the vest or target area 22 associated with the red contestant.

As will be explained, the following sequence of operation occurs. When the blue contestant strikes the target area of the red contestant, the blue contestant's glove, either the left- or the right-hand glove, emits a frequency F1 indicative of the strike frequency. If the blue contestant struck the target area associated with the vest 22 of the red contestant then the striking of the target area will emit the frequency F4. Hence, for the blue contestant to score a point or indicate a blow, the frequencies F1 and F4 will be transmitted.

These frequencies are detected by means of the judges receiver via an AND gate configuration as will be further explained and will operate to illuminate a light or sound a particular alarm associated with the blue contestant indicating that the blue contestant has in fact scored. In a similar manner, if the red contestant strikes the target area 11 of the blue contestant, the following operations will occur. Due to the fact that the red contestant struck the blue contestant's target area, he will emit the frequency F3 which is his strike frequency. Based on the fact that he contacted the target area associated with the vest 11 of the blue contestant, the frequency F2 will be emitted.

Hence, for the red contestant to score or indicate a blow being struck the frequencies F3 and F2 will be transmitted. The transmission of these two frequencies are again detected by a simple receiver and indicative of a valid strike by the red contestant. It is immediately noted that each and every time a contestant makes any strike or any hit the associated strike frequencies as F1 and F3 are transmitted. However, this will not indicate a score due to the fact that the appropriate target frequencies will not be transmitted unless the target area of each contestant is contacted directly.

In this manner, the above apparatus eliminates all blows which are not within the target area and such blows outside the target area will not in any manner indicate a score.

Figure 3:
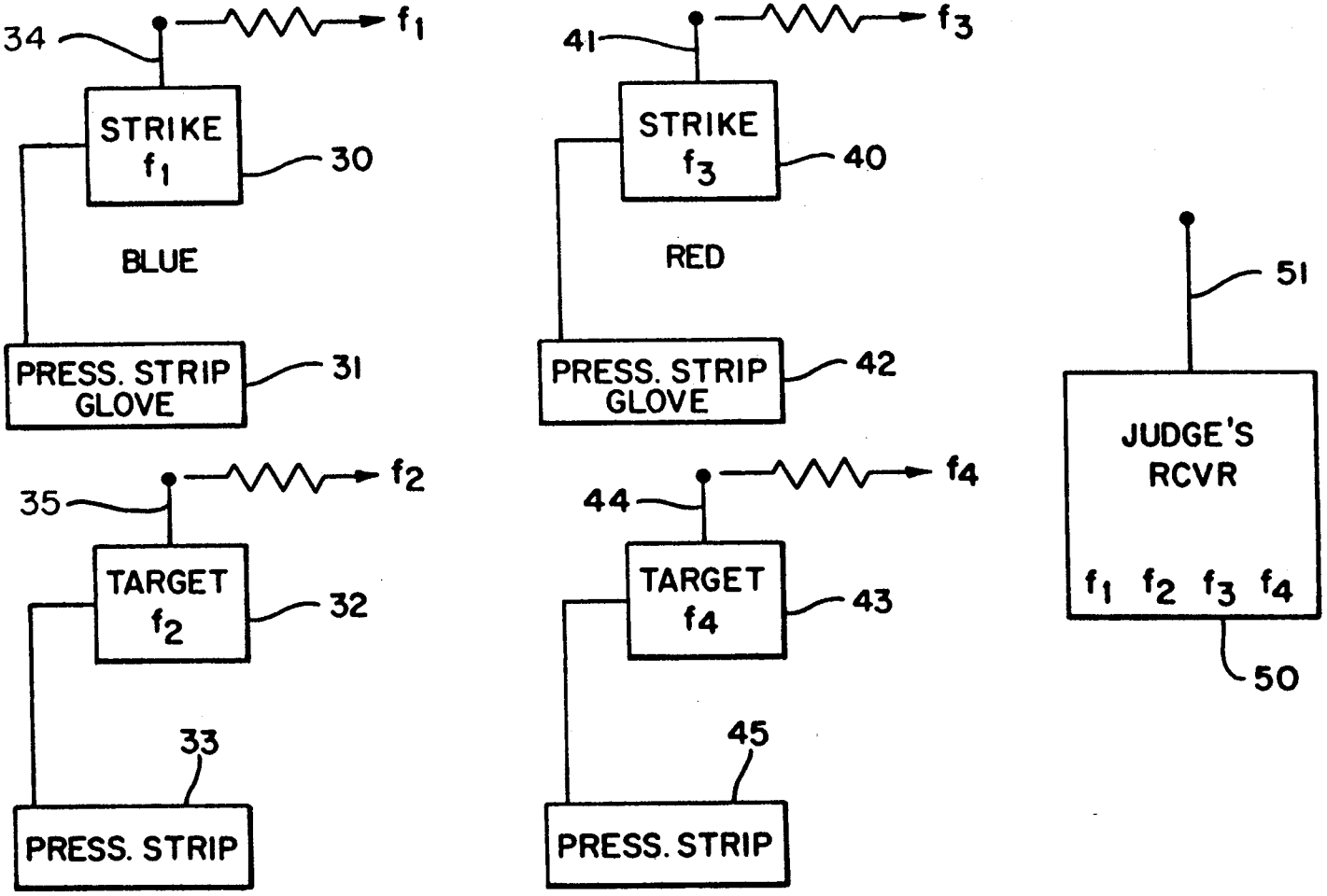
FIG. 3 is a simple block diagram showing the apparatus according to this invention.

Referring to FIG. 3, there is a simple block diagram useful in explaining the above-noted operation. As seen from FIG. 3 there is shown the apparatus associated with the blue and red contestants. Essentially, the blue contestant has a transmitter 30 which is associated with his glove and which transmitter is associated with a pressure strip as a pressure sensitive device 31.

As seen from FIG. 3, the pressure sensitive device 31 when activated will cause transmitter 30 to transmit a frequency F1 via an antenna 34. As indicated above, due to the fact that the frequencies transmitted are relatively high frequencies the transmitter circuit can be extremely small as well as the antenna element. At such frequencies, for example in the FM or telemetry band, the antenna can be less than a few inches and can be fabricated from any suitable configuration such as a particular length of wire indicative of $\frac{1}{4}$ of the wavelength of the transmitted frequency and so on.

Such transmitting devices are well known in the art and many examples of such transmitters are available. Also associated with the blue contestant is a pressure strip 33 which for example would be implemented within the vest 11 of the contestant. The pressure strip 33 is associated with a second transmitter designated as a target transmitter 32 which also has an antenna 35.

Hence, when the pressure strip 33 is touched or struck, this enables transmission by the transmitter 32 of the frequency F2 which is the target frequency. In a similar manner, the red contestant has a strike transmitter 40 associated with an antenna 41 which will transmit the frequency F3 when a pressure strip 42 is activated due to the red contestant's glove striking an object. The red contestant also has a target transmitter 43 associated with an antenna 44 which is activated by a pressure strip 45 associated with his vest and which is operative to transmit the frequency F4 when the target area associated with the red opponent is accessed or struck.

Also shown in FIG. 3 is a judge's receiver or receiving device 50. The receiving device 50 contains an antenna 51 which is omni-directional and capable of receiving any of the frequencies F1, F2, F3, and F4. As will be explained, the receiver is a relatively simple configuration and operates to provide an indication of a strike or effective blow by responding to both the strike frequency and target frequency.

Figure 4:
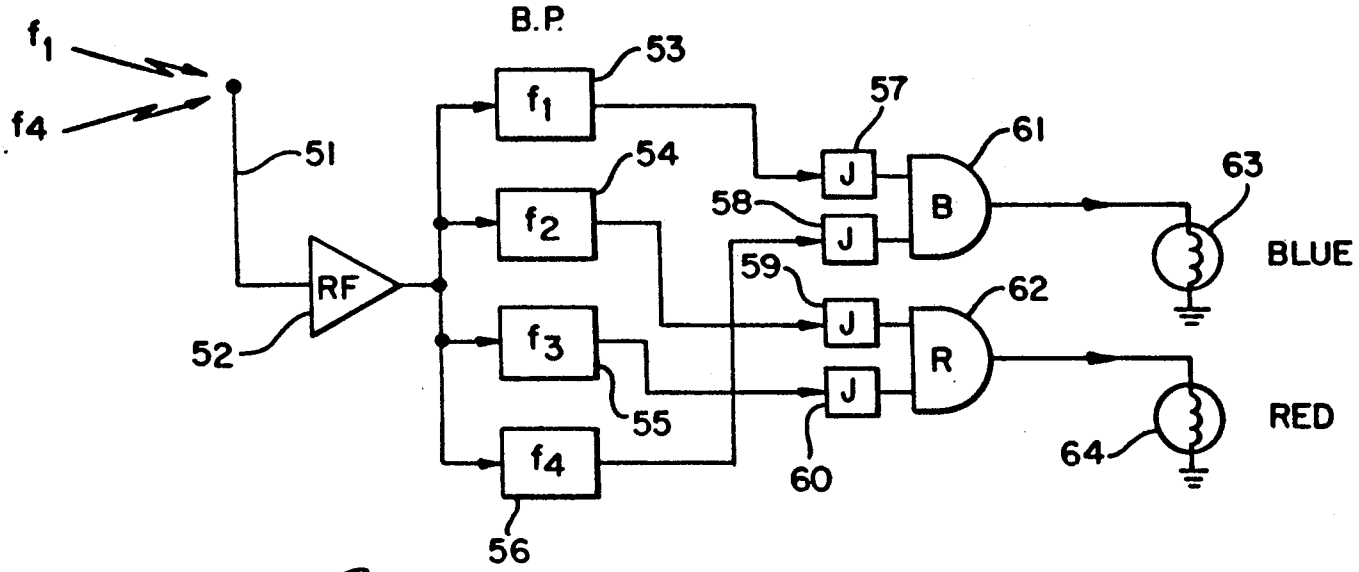
FIG. 4 is a simple block diagram showing a receiver which will respond to signals generated according to this invention.

Referring to FIG. 4, there is shown a simple block diagram of the judge's receiver 50 as for example shown in FIG. 3. As seen from FIG. 4, there is an antenna 51 which is capable of receiving any of the transmitted frequencies as F1 to F4. The antenna is coupled to an RF amplifier 52 which is also a conventional circuit component. RF amplifier 52 may for example contain suitable noise discriminating circuitry and limiting circuitry to provide at an output replicas of the received frequencies.

Coupled to the output of the RF amplifier 52 is a plurality of bandpass filters 53, 54, 55, and 56. As seen, each bandpass filter is a relatively narrow device having a narrow bandwidth which may, for example be a crystal controlled filter or a filter employing operational amplifiers with suitable feedback components thereby giving an extremely narrow bandwidth capable of passing the frequencies, as for example transmitted by both contestants.

Thus, as seen, the output of the RF amplifier 52 is coupled to the bandpass filters 53, 54, 55 and 56, each one having an extremely narrow bandwidth at a center frequency of F1, F2, F3, and F4. As seen from FIG. 4, the output of each filter is coupled to a suitable integrator circuit as 57, 58 59, and 60. The function of the integrator circuit is to peak or average detect the alternating signal emanating from the bandpass filter and to provide a suitable DC signal indicative of the same.

The outputs of the integrators are associated with AND gates 61 and 62. The AND gate 61 for example, will become activated when a valid strike is implemented by the blue contestant while the AND gate 62 will be activated when a valid strike is implemented by the red contestant. As seen from FIG. 4, the output of filter 53 is coupled to the integrator 57 whose output is coupled to one input of AND gate 61. This input is indicative of the frequency F1 being transmitted which is the strike frequency of the blue contestant. The other input to AND gate 61 is supplied via a bandpass filter 56 having its output coupled to the input of integrator 58 whose output is coupled to the other input of the AND gate 61. This frequency F4 as indicated above is the target frequency of the red contestant. Hence, when the red contestant's vest is struck, the frequency F4 will be transmitted. Thus, based on the apparatus shown in FIG. 4, it is immediately understood that the blue contestant will be awarded a strike upon the transmission of frequency F1 and F4.

This will activate AND gate 61 which can be coupled to a suitable lamp 63 or other indicator for indicating that the blue contestant has struck a blow. In a similar manner, the red contestant is associated with the AND gate 62. AND gate 62 has one input emanating from the output of filter 54 indicative of the transmission of frequency F2 and another input coupled to the output of filter 55 indicative of the transmission of frequency F3. Hence, the AND gate 62 will become activated when the red contestant provides a valid strike, namely, by transmitting his glove frequency F3 and by striking the target area causing frequency F2 to be transmitted.

The output of AND gate 62 in a similar manner is coupled to an indicator 64 for indicating that the red contestant has made a strike. It is also known in regard to FIG. 4 that the circuitry for implementing the bandpass filters as well as the gates 61 and 62 and the integrators are all known in the prior art, and many integrated circuits are available which will provide such functions. It is also indicated that due to the local nature of a karate contest, the transmission requirements for each of the transmitters are extremely small and one can use extremely small and convenient components which are light weight.

Figure 5:
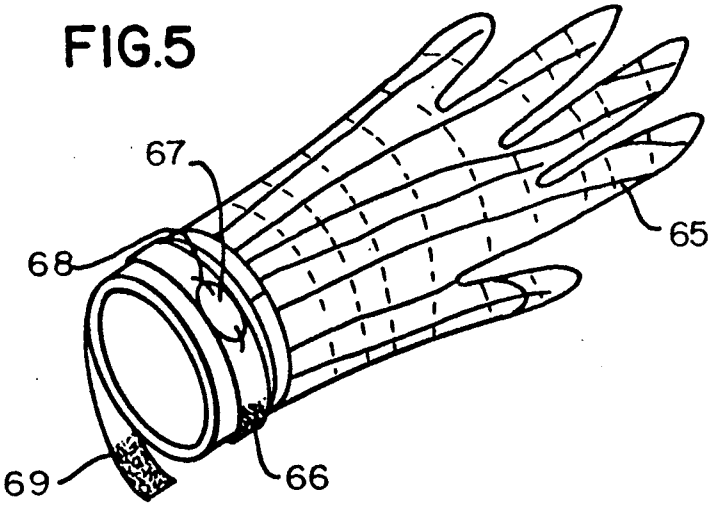
FIG. 5 is a perspective plan view of a pressure sensitive glove utilized in accordance with this invention.

Referring to FIG. 5, there is shown a glove 65. This is the type of glove which would be worn by the contestants. The glove 65 is fabricated from a pressure sensitive material. Many examples of pressure sensitive materials exist in the prior art. There are various companies that produce pressure sensitive mats and other pressure sensitive devices. These devices are fabric-like devices which contain conducting leads separated by a suitable space. When a pressure is applied, the conducting leads operate to produce a closed contact. Essentially, the glove 65 employs a pressure sensitive fabric-like area which is coupled to a wristband 66 having located on the same a transmitter 67 and an antenna 68.

The glove 65 may have a VELCRO band 69 so that each glove can be suitably adjusted by the contestant in order to provide comfort and so on.

Figure 6:
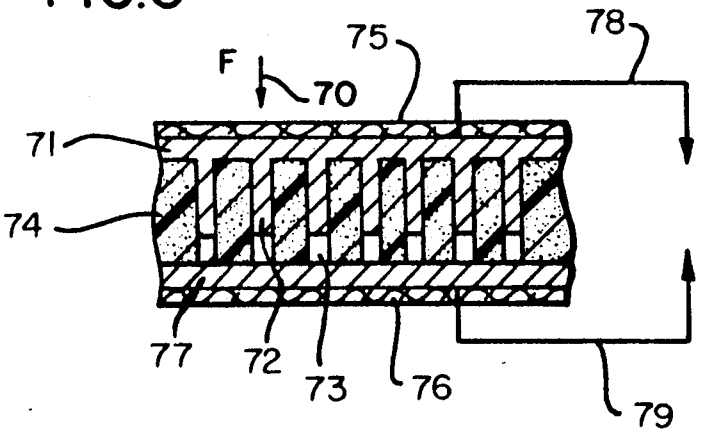
FIG. 6 is a cross-sectional view showing a pressure sensitive material which can be utilized in accordance with this invention.
Figure 7:
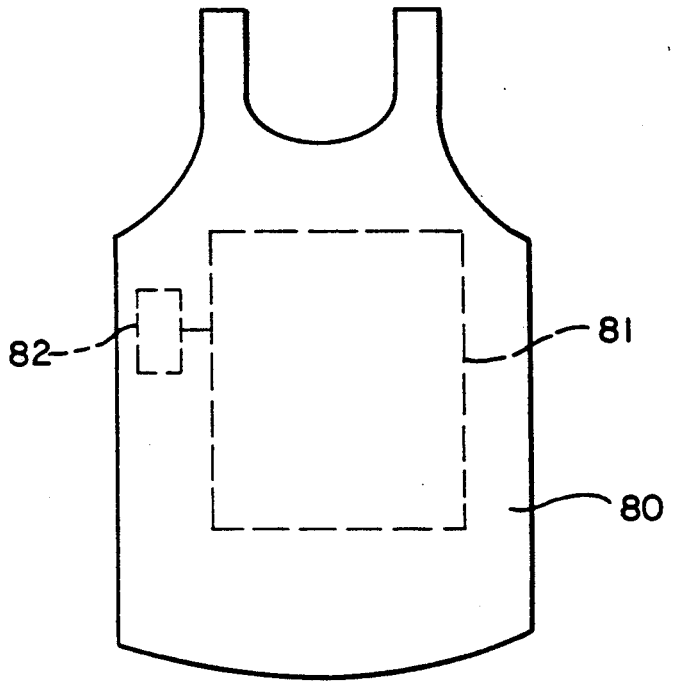
FIG. 7 is a front view of a typical vest having a target area employed with this invention.

Referring to FIG. 6, there is shown an enlarged cross-sectional example of a pressure sensitive material which can be employed to fabricate both the glove 65 of FIG. 5 and the vest or target area of FIG. 7. Essentially, as seen, the pressure sensitive device consists of a first conductive material or element 71 which is associated with projecting fingers 72 disposed along the length thereof. The conductive material 71 may be a suitable plastic which is impregnated with conducting particles or a thin foil configuration as is well known in the art.

Such foil configurations may include a MYLAR base material having deposited thereon a suitable metal element. The projections or fingers 72 are included in slots 73 and are supported in position by means of a insulative foam-like material 74. As one can see from FIG. 6, if a force 70 is directed onto a surface 75 of a material 76, projection 72 would come into contact with the layer 77 thus creating a short circuit between lead 78 and 79. It is also immediately understood that based on the nature of the foam material 74, as well as the separation between the ends of the projection 72 in regard to the layer 77, the amount of force necessary to insure closure of the circuit is readily adjustable. Hence, such materials can operate with different force ratings. The advantage of variable impact adjustment is that contestants of more advanced skill and strength can be required to deliver more forceful blows in order to register a score, while less experienced competitors may be spared from injury by employing pressure sensitive materials having a lower force rating.

As indicated, the structure shown in FIG. 6 is by way of example and pressure sensitive materials such as pressure sensitive mats or pressure sensitive devices are available from many manufacturers. It is indicated that both the glove 65 as shown in FIG. 5 and the vest 80 as shown in FIG. 7 both include such a pressure sensitive material.

As shown in FIG. 7, there is a vest 80 which is worn in a conventional manner and is secured at the back. Apart from the vest one can have a pad which is strapped to the user. It is indicated that there are many different combinations which can be worn by a user indicative of the target area.

As shown in FIG. 7, the vest 80 is associated with the target area 81 which essentially includes a pressure sensitive material such as that shown in FIG. 6. Also included within the vest and which may be located on the backside thereof, is the target transmitter 82 which is associated with an antenna and its own internal battery. The transmitters will operate upon a strike by an opponent in the target area 81 associated with the vest 80.

Figure 8:
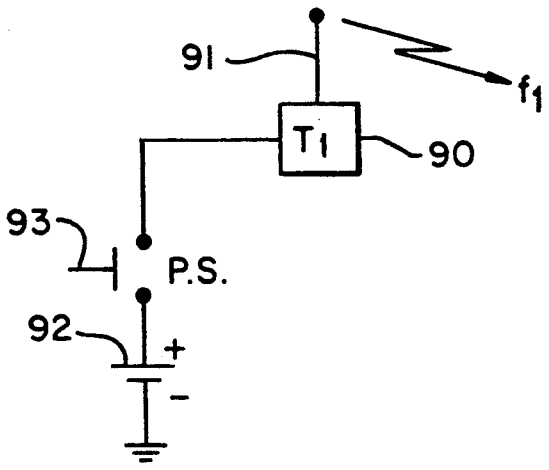
FIG. 8 is a simple schematic diagram of a transmitter utilized in conjunction with a pressure sensitive switch in accordance with this invention.

Shown in FIG. 8 is a simple diagram of each of the transmitter circuits which will be employed in conjunction with the glove as well as each target area. As seen from FIG. 8, the transmitter 90 is a conventional component associated with an antenna 91 which as indicated above, due to the high frequencies utilized in this invention, is a relatively small device.

A source of potential 92 such as a suitable battery is coupled via the pressure sensitive switch 93 to the transmitter 90. Hence, as seen from FIG. 8, if the switch 93 is closed by a blow imparted on the target area or by a blow imparted via the glove, the switch 93 will close causing the transmitter 90 to propagate or transmit the associated frequency. In this manner, each contestant will propagate the two frequencies indicative of a blow as above described. It is understood that while the target area 81 is shown as rectangular in shape, it can be of any configuration desired. It is further indicated that pressure sensitive materials are available from many sources, and for example, such devices are sold as annunciator mats and so on, whereby a rug-like member which is fabricated from cloth possesses switching capabilities if a load is impressed thereon.

In view of the above it should be apparent to those skilled in the art that there are many alternative designs which are deemed to be encompassed within the breadth and scope of the claims as appended hereto.

What is claimed is:

1. An adjustable pressure sensitive means employed to indicate valid strikes scored in a karate match between first and second contestants engaged in combat according to the martial art of karate, said pressure sensitive means comprising:

first and second conductive elements with a slotted compressible insulation material located between said conductive elements, said first conductive element having projecting fingers located in said slots of said insulation material and extending part way through said slots of said insulation material, said insulation material being adjustable to compress in response to sufficient pressure being applied to said first element, and output means coupled to said first and second conductive elements for providing an output frequency, whereby upon sufficient pressure being applied to said first conductive element said insulation material compresses allowing said fingers to make electrical contact with said second conductive element such that said output frequency is provided.

2. The adjustable pressure sensitive means according to claim 1, further including a transmitter coupled to said pressure sensitive means for transmitting said output frequency.

3. The adjustable pressure sensitive means according to claim 1, wherein said insulation material is a foam material.

4. The adjustable pressure sensitive means according to claim 1, wherein said first conductive element is a material impregnated with conducting elements.

5. The adjustable pressure sensitive means according to claim 4, wherein said material is plastic.

6. A glove having an adjustable pressure sensitive means to indicate valid strikes scored between first and second contestants engaged in combat according to the martial art of karate, the adjustable pressure sensitive means comprising:

first and second conductive elements with a slotted compressible insulation material located between said conductive elements, said first conductive element having projecting fingers located in said slots of said insulation material and extending part way through said slots of said insulation material, said insulation material being adjustable to compress in response to sufficient pressure being applied to said first element, and output means coupled to said first and second conductive elements for providing an output frequency, whereby upon sufficient pressure being applied to said first conductive element said insulation material compresses allowing said fingers to make electrical contact with said second conductive element such that said output frequency is provided.

7. The glove according to claim 6, wherein at least one glove is worn on a hand of said first contestant and operative to transmit a first frequency when a blow is struck by said first contestant and at least one glove is worn on a hand of said second contestant and operative to transmit a second frequency when a blow is struck by said second contestant.

8. The glove according to claim 7, further including an additional glove on the hand of said first and second contestants operative to provide said first frequency for said first contestant and said second frequency for said second contestant.

9. An apparatus for scoring valid strikes in a karate match wherein first and second contestants engage in combat according to the martial art of karate, said apparatus capable of responding to a valid strike rendered by one contestant to a designated target area associated with the other contestant, said apparatus comprising:

first means associated with the hands of said first and second contestants and operative to provide first distinct and different output frequencies when the hand of said contestant strikes a blow, with said output frequency of said first contestant providing a first frequency indicative of a hand strike and said second contestant providing a second frequency indicative of a hand strike, said first means including first adjustable pressure sensitive means having first and second conductive elements with a slotted compressible insulation material located between said conductive elements, said first conductive element having projecting fingers located in said slots of said insulation material and extending part way through said slots of said insulation material, said insulation material being adjustable to compress in response to sufficient pressure being applied to said first element, and output means coupled to said first and second conductive elements for providing an output frequency, whereby upon sufficient pressure being applied to said first conductive element said insulation material compresses allowing said fingers to make electrical contact with said second conductive element such that said output frequency is provided, second means including a first vest having an adjustable pressure sensitive target area coupled to a transmitter worn by said first contestant and a second vest having an adjustable pressure sensitive target area coupled to a transmitter worn by said second contestant and operative to provide distinct and different output frequencies when said target areas of said contestants are struck by a blow, said adjustable pressure sensitive target areas including second adjustable pressure sensitive means having first and second conductive elements with a slotted compressible insulation material located between said conductive elements, said first conductive element having projecting fingers located in said slots of said insulation material and extending part way through said slots of said insulation material, said insulation material being adjustable to compress in response to sufficient pressure being applied to said first element, and output means coupled to said first and second conductive elements for providing an output frequency, whereby upon sufficient pressure being applied to said first conductive element said insulation material compresses allowing said fingers to make electrical contact with said second conductive element such that said output frequency is provided, with said target area of said first contestant providing a third frequency output when struck and said target area of said second contestant providing a fourth output frequency when struck, means responsive to the presence of said first frequency and said fourth frequency outputs simultaneously to provide an output signal indicative of a valid blow struck by said first contestant and responsive to said second and third frequency outputs simultaneously to provide an output signal indicative of a valid blow struck by said second contestant whereby a valid output is provided when the hand of one contestant strikes the target area of said other contestant.

10. The apparatus according to claim 9, wherein said first means includes at least one glove worn on a hand of said first contestant and operative to transmit said first frequency when a blow is struck by said first contestant and at least one glove worn on a hand of said second contestant and operative to transmit said second frequency when a blow is struck by said second contestant.

11. The apparatus according to claim 10, further including an additional glove on the hand of said first and second contestants operative to provide said first frequency for said first contestant and said second frequency for said second contestant.

12. The apparatus according to claim 10, wherein each glove includes a pressure sensitive means for providing an output when a blow is struck and a transmitter coupled to said pressure sensitive means for transmitting said associated frequency.

13. The apparatus according to claim 9, wherein said means responsive to the presence of said frequencies includes a radio receiver for receiving said first to fourth frequencies and including first gating means operative to pass said first and fourth frequencies and second gating means operative to pass said second and third frequencies when present.

14. The apparatus according to claim 13, including first indicator means coupled to said first gating means to provide an indication of the passing of said first and fourth frequencies indicative of a valid blow struck by said first contestant and second indicator means coupled to said second gating means to provide an indication of the passing of said second and third frequencies indicative of a valid blow struck by said second contestant.

15. The apparatus according to claim 13, wherein said first and second gating means are AND gates.

16. The apparatus according to claim 14, wherein said first and second indicators are lamps for providing a visual indication of a valid strike.

* * * * *